US005413544A

United States Patent [19]

Fiore

[11] Patent Number: 5,413,544

[45] Date of Patent: May 9, 1995

[54] EXERCISING SCOOTER

[76] Inventor: Russell D. Fiore, 6 Red Chimney Dr., Lincoln, R.I. 02865

[21] Appl. No.: 205,793

[22] Filed: Mar. 4, 1994

[51] Int. Cl.[6] ..... A63B 22/20

[52] U.S. Cl. ..... 482/68; 482/146; 280/87.041

[58] Field of Search ..... 482/66, 68, 146, 147; 280/87.01, 87.021, 87.041, 87.5

[56] References Cited

U.S. PATENT DOCUMENTS

| | | | |
|---|---|---|---|
| 1,890,755 | 12/1932 | Shepard | 280/87.041 |
| 3,887,210 | 6/1975 | Funke | 280/87.01 |
| 4,126,326 | 11/1978 | Phillips | 280/87.041 |
| 4,775,162 | 10/1988 | Chao | 280/87.041 |
| 4,776,604 | 10/1988 | Valdez et al. | 280/87.041 |

FOREIGN PATENT DOCUMENTS

| | | | |
|---|---|---|---|
| 2361262 | 12/1976 | France | 280/87.01 |

*Primary Examiner*—Richard J. Apley
*Assistant Examiner*—Lynne A. Reichard
*Attorney, Agent, or Firm*—Robert J. Doherty

[57] ABSTRACT

A multi-use exercising device in which the exerciser rests or supports a body portion on a generally planar receiving or supporting surface provided by the device such that the exerciser may propel the device across a supporting surface by applying force by body members other than that body portion supported by the device and in which means are provided for varying the force which is required to propel the device in the intended manner.

14 Claims, 6 Drawing Sheets

EXERCISING SCOOTER

BACKGROUND AND OBJECTS OF THE INVENTION

This invention relates to an exercising device and more particularly to a device which has utility in closed chain kinetic exercise, that is, wherein the end segment (the foot or hand) is not free. The foot or hand is, e.g., on the ground, and the axis of motion is both distal and proximal to the injured area. An example of such type exercise would include the effect obtained from a person moving about on a mechanic's creeper either face up or face down depending on the desired body portions being exercised or that achieved by operating an old-fashioned scooter.

Applicant is aware of a number of exercising devices that fit this general description including U.S. Pat. Nos. 3.672,670 to Burzenski issued Jun. 27, 1972; 3,976,155 to Esch issued Aug. 24, 1976; 4,451,037 to O'Hare issued May 29, 1984; and 4,700,945 to Rader issued Oct. 20, 1987 as well as a number of more general exercising devices and mechanisms including U.S. Pat. Nos. 2,642,286 to Leroy issued Jun. 16, 1953; 2,819,081 to Touraine issued Jan. 7, 1958; 4,132,404 to Wilson issued Jan. 2, 1979; 4,374,519 to Stauft issued Feb. 22, 1983; 4,402,506 to Jones issued Sep. 6, 1983; 4,892,305 to Lynch issued Jan. 9, 1990; 4,989,860 to Iams et al issued Feb. 5, 1991; 5,035,445 to Poulin issued Jul. 30, 1991; and 5,066,005 to Luecke issued Nov. 19, 1991. Despite the existence of these disclosed prior art mechanisms, a need still exist for a simple yet rugged device which is both flexible with respect to the different body parts that may be exercised therewith but does so in a dynamic fashion and closed kinetic chain manner in which progressive resistance can be easily and repeatedly achieved by the device. These and other objects of the invention are accomplished by a multi-use exercising device for use on a horizontal surface including a frame in turn including an essentially planar supporting surface for supporting a body portion of an exerciser and further defining a lateral plane, said frame having floor first contact means which enable said frame and thus said supporting surface to freely move in a multitude of directions within said lateral plane such that an exerciser may position said body portion on said supporting surface while moving said frame in one or more of said directions by exerting force on said horizontal surface with other body portions which are not supported on said supporting surface such that the device and exerciser are mutually propelled by such exerting force, said frame having floor second contact means entirely separate from said floor first contact means, and said second contact means including means for adjusting the resistance to movement of said frame such that both the exerciser exerting force needed to move said frame can be progressively increased or decreased dependent on exercise requirements.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 11:
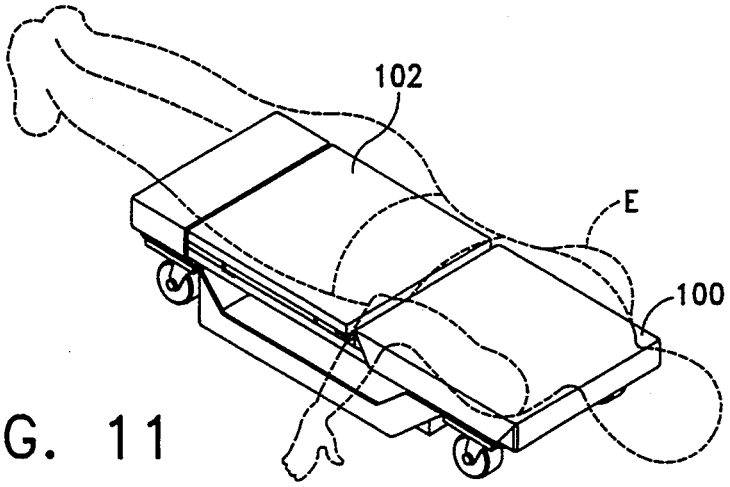
FIGS. 11 through 13 are schematic views showing some of the different manners in which the device of the present invention may be utilized to exercise various body portions.
Figure 12:
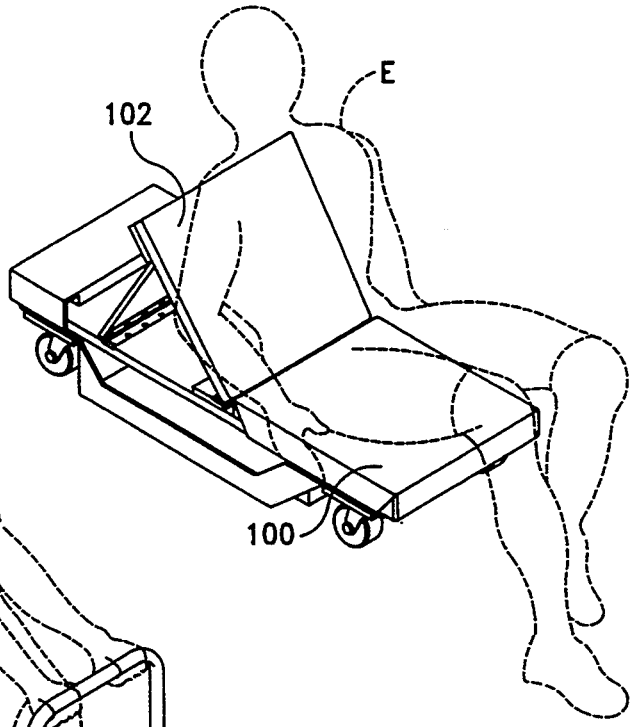

Turning now to the drawings and particularly FIGS. 1 through 4 thereof, one form of the device 10 of the present invention is depicted. Therein the device 10 includes a frame 12 having opposed upper and lower surfaces 14, 16 respectively. The upper surface or at least a portion thereof forms a planar supporting surface for a body portion of a exerciser generally a human but other animals are not excluded. In this embodiment of the invention, the supporting surface 18 is shown recessed with respect to forward and rear shelf portions 20 and 22 of the frame. Such recessed position of the supporting surface 18 is particularly useful when the device is used for exercise of the foot such as the scooter-type operational format of the device particularly shown in FIG. 3 such that the person's foot is close to the horizontal floor supporting both the exerciser and the device 10 to reduce some awkwardness that would be present should the supporting surface 18 form a continuation of the shelf portions 20 and 22 but such a construction is not precluded and is specifically shown as an alternate embodiment such as shown in FIG. 11 wherein the exerciser body or foot may be supported on such surface.

The frame 12 is normally of integral construction and may be separately formed from welded sheets of metal or integrally formed from an engineered plastic material as by injection molding. The lower surface 16 of the frame includes a plurality of pads 26 which in turn support free rolling rollers 28 via freely rotatable bifurcated supports 30. In this way, the frame is free to move across the horizontal floor in any number of directions dependent upon the exerciser's wishes. In order to achieve such movement, it is necessary for the supporting surface 18 and particularly the lower surface thereof to be positioned at a height slightly higher than that position which the plurality of rollers 28 make contact with the horizontal floor. It should be pointed out. that it is, however, unnecessary that a roller assembly be positioned at all four corners of the device especially when the overall configuration of the device is not rectangular although such format is generally preferred since the shape may also include triangular, narrow rectangular or other shapes in which less than four roller assemblies are positioned at each of the four corners of the device. Alternatively, more than four roller assemblies may be utilized if necessary, and other means other than roller assemblies can be utilized to support the frame in a manner to effect easy movement in any number of different directions across the horizontal, supporting floor surface.

In order to convert what, in essence, is a free moving frame assembly as discussed above into an exercise device of the present invention, it is necessary to be able to control the ease or degree of difficulty for the exerciser to move the device with respect to the floor. Such is accomplished by the provision of a second contact means entirely separate from the roller assemblies 24 and by which varying amounts of resistance to the free movement of the device across the floor may be regulated. Alteration of the roller assemblies in an attempt to provide such varied resistance was found undesirable as it altered the movement of the device, Such second contact means or brake assembly 32 is shown in FIGS. 1 through 6, Such brake assembly 32 includes a box-like rectangular housing 34 downwardly extending from the lower surface of the forward shelf portion and exhibiting an open lower end 36, A portion of the housing 34 may be formed by the vertical connecting shelf or wall 38 between the supporting surface 18 and the forward shelf portion 20 or alternatively may be independent from such connecting wall 38 as by the presence of opposed pairs of side walls 40 and 42, One such side wall pair 40 are each provided with opposed slots 44, The housing 34 is adapted to receive a similarly shaped box or housing 48 also having a pair of side. walls 50 including opposed slots 52. The secondary housing 48 is slidably vertically received into the box housing 34. A bearing pad 54 having a suitable lower contact surface 56 adapted to contact the supporting floor which is normally carpeted is provided at the lower end of the secondary box 48. A coil spring 58 is in turn positioned within the secondary box 48 and is further connected at its lower end to the pad 54 upper surface by any known mechanism such as welding or the clamp screw 60 depicted and at its upper end to a positioning head 62. Such positioning head 62 may take the form of a cylinder attached at its bottom end to the upper end of the spring 58 and extending thereabove at its upper end 64. Such upper end 64 of the head is provided with a laterally extending bore through which a carriage bolt 66 is adapted to extend. The carriage bolt includes square lower end portions 68 which are adapted to extend into one of the slots 52 to prevent the bolt 66 from turning. The other and threaded end of the carriage bolt 66 is attached to a threaded adjusting knob 70. The suitable positioning of washers 72 and 74 inside and outside of the housing 34 enables the positioning head 62 to be positioned vertically at different positions along the slots 52. Such positions cab be represented by the scale imprinted or otherwise placed upon the outer surface of wall 38 as shown in FIG. 6. In this way then, the knob can be temporarily affixed in any of the numbered positions shown such that the desired exercise resistance can be duplicated.

Figure 5:
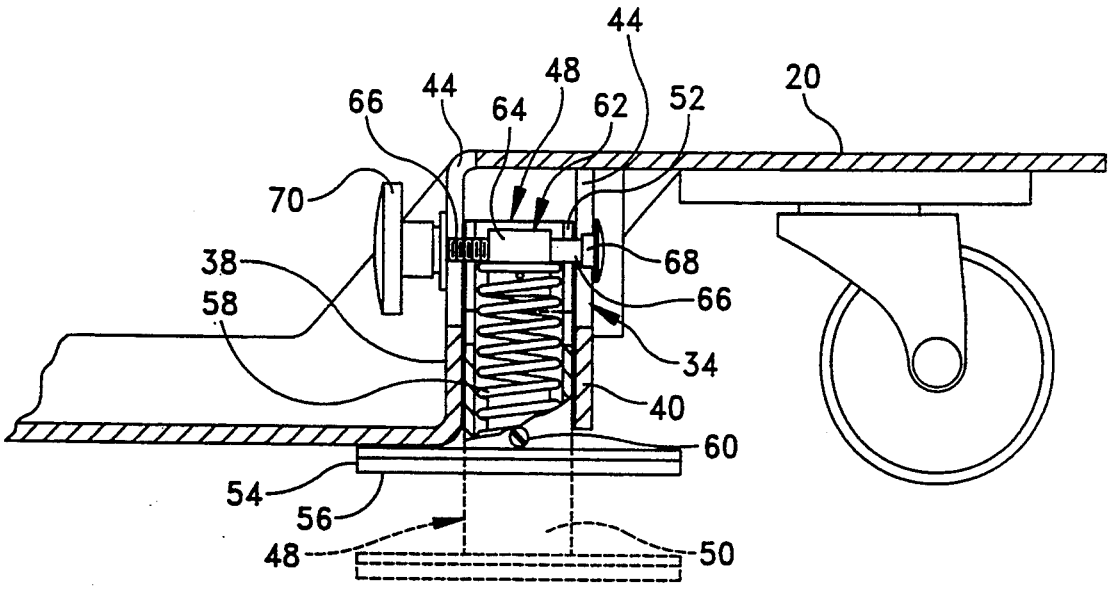
FIG. 5 is a sectional view along the line 5—5 of FIG. 3.
Figure 6:
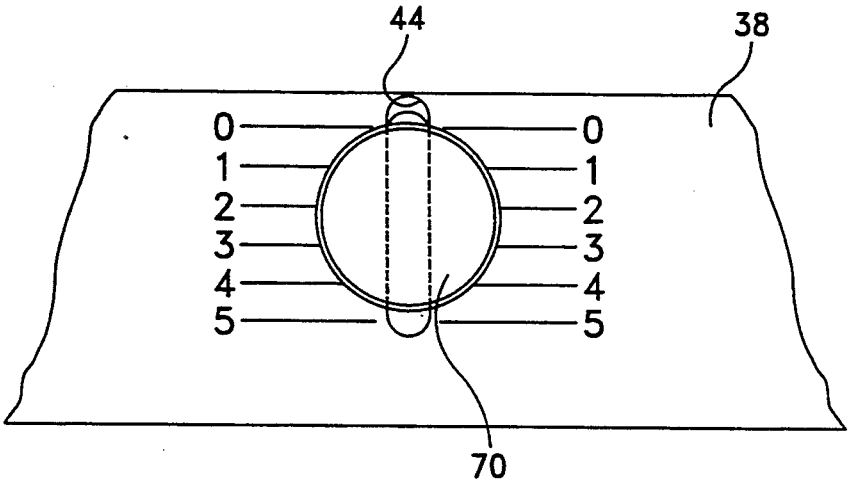
FIG. 6 is a partial elevational view taken from the left side of FIG. 3.
Figure 7:
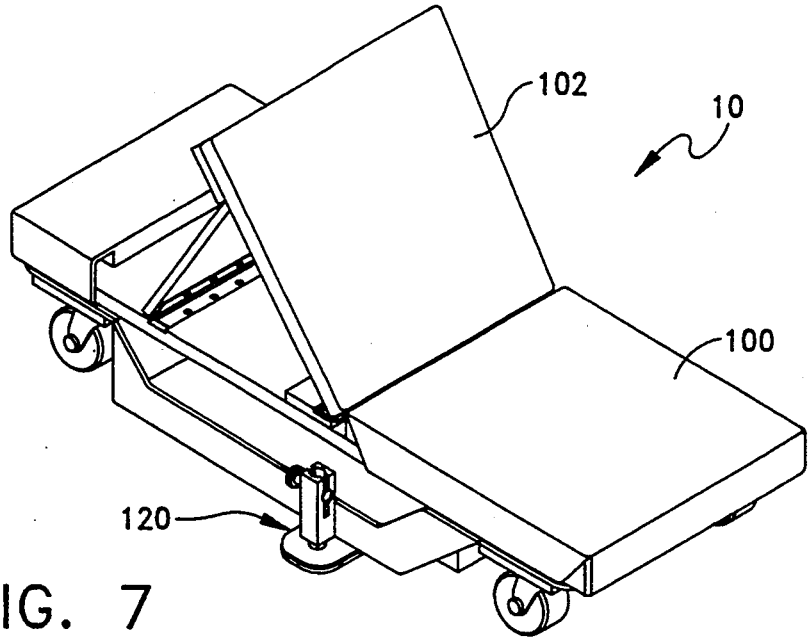
FIG. 7 is a perspective view similar to FIGS. 1 and 2 but showing an alternate embodiment of the present invention.
Figure 8:
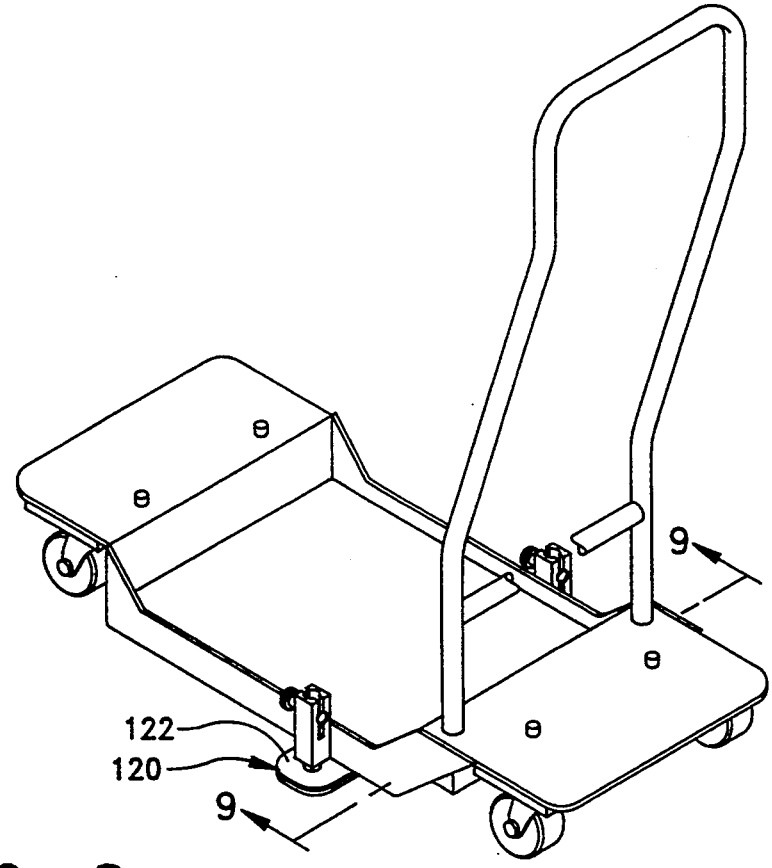
FIG. 8 is a perspective view similar to FIG. 3 also depicting the alternate embodiment shown in FIG. 7.
Figure 9:
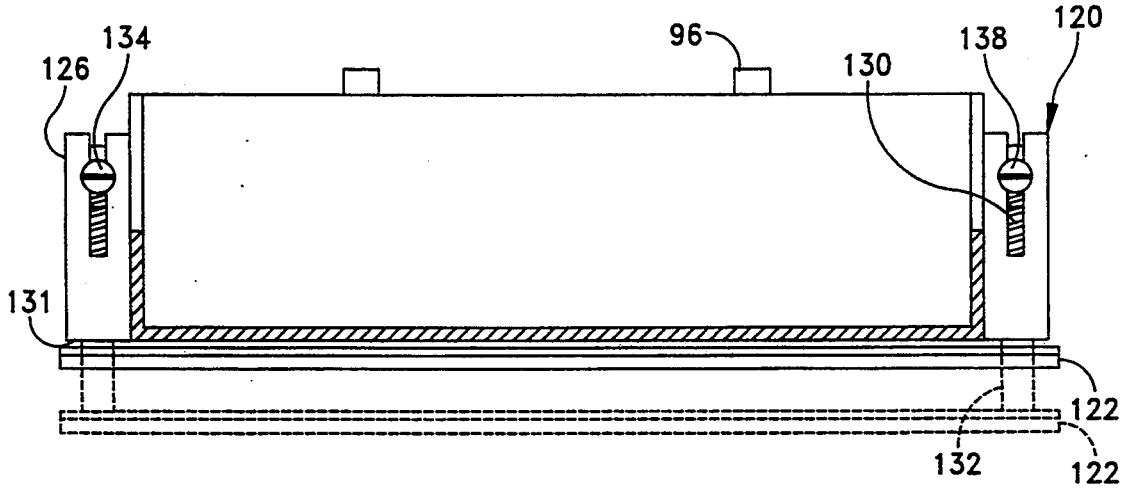
FIG. 9 is a sectional view along the line 9—9 of FIG. 8.
Figure 10:
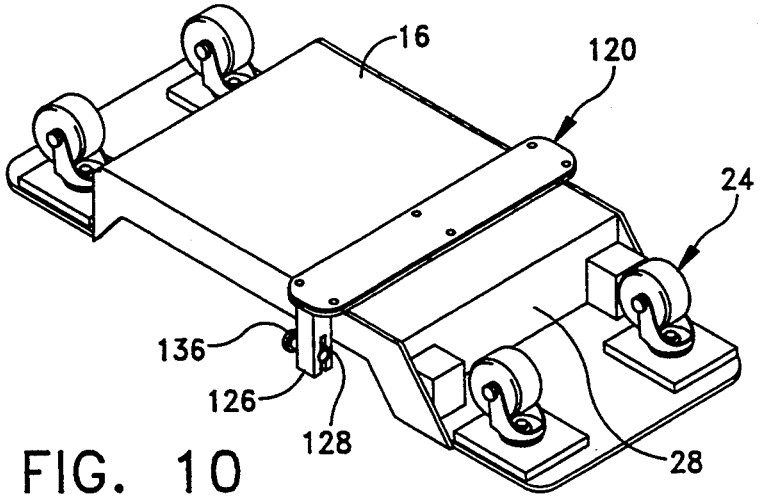
FIG. 10 is a reverse perspective view of the alternate embodiment shown in FIGS. 7 through 9.

In such positioning, the pad 54 will move downwardly and upwardly as shown by the solid and dotted line representations in FIG. 5 from a position shown in the solid lines which essentially is in line with the contact point of the rollers 28 with the supporting floor surface and in such position will affect only a slight resistance to moving of the frame by reason of the contact between the lower pad surface and the supporting floor. In the dotted line representation, the pad 54 has been moved downwardly and is normally positioned by a tightening of the knob 70 so as to fix the relative position of the primary and secondary housing 34 and 48. However when the device is placed in a use position, the combined weight of the device and that of the exerciser supported thereon will tend to force the pad and secondary box assembly 48 upwardly against the action of the coil spring to enable movement of the frame with respect to the supporting floor. In that way then, the rolling resistance of the device when supported by the floor can be increased or decreased and thus require the exerciser to overcome that force in order to move the device with respect to the floor by the propelling force imparted thereto by whichever body portion is being exercised by the exerciser.

Figure 3:
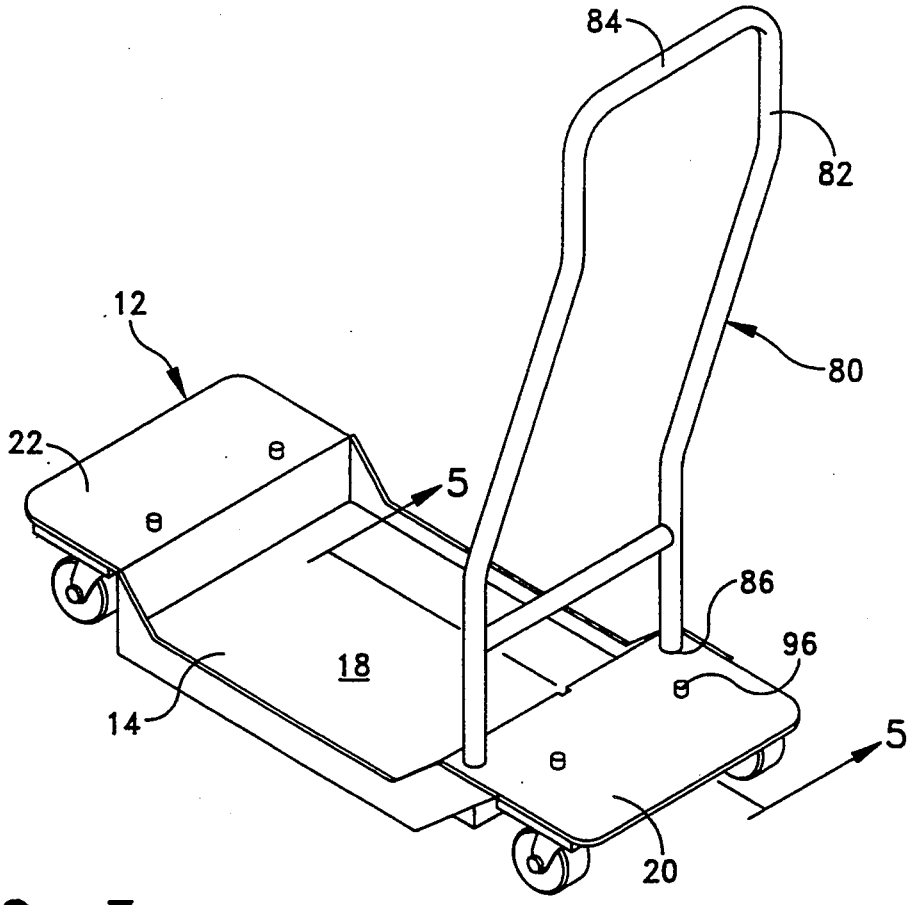
FIG. 3 is a perspective view similar to FIGS. 1 and 2 but showing a still further alternate body supporting position thereof.
Figure 4:
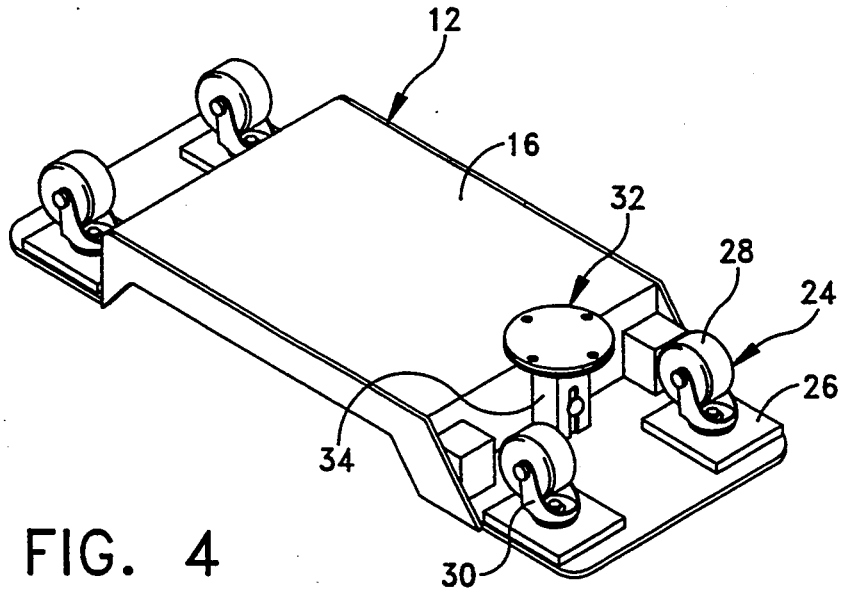
FIG. 4 is a perspective view of the under surface of the device shown in FIGS. 1 through 3.
Figure 13:
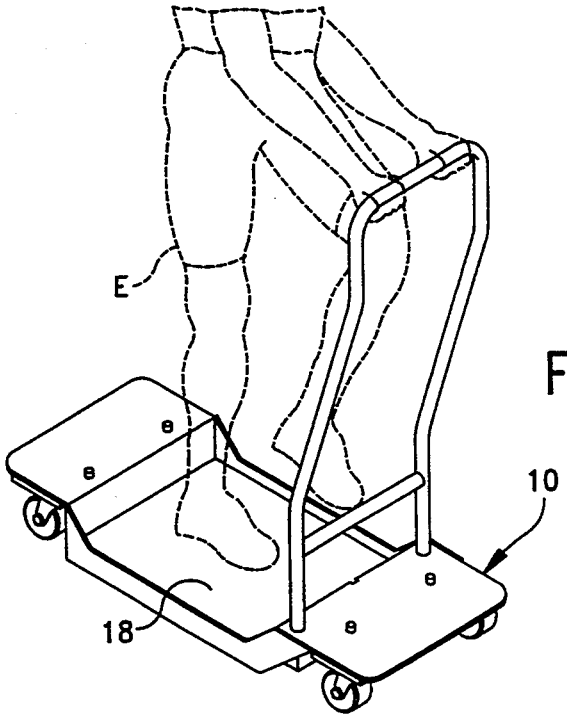

For instance, if the exerciser is using the device in the scooter position shown in FIG. 3, then one foot would be disposed and resting upon the supporting surface 18 while the other foot and leg would be providing the propelling movement to move the device across the supporting floor. In such use position, it should also be pointed out that a frame member or upright support 80 can be positioned on the forward shelf portion 20 to provide support for the exerciser's arms and upper body during such exercise. Such support 80 is generally of a upright nature and includes opposed side bar portions 82 connected by an upper bar 84 to present an overall U-shaped configurations. Also, a straight, singular piece of tubing may be used for support and be positioned on either side or in the middle. Generally the bars are formed from hollow tubular metal members and can be positioned into blind holes 86 formed in the upper surface of the forward shelf portion 20. When the device is not utilized in its scooter position shown in FIG. 3, such upright support 80 can be easily removed from the frame. The modes in which the device 10 can be used are shown in FIG. 13 wherein an exerciser E may move the device 10 forward or rearward, side to side, diagonally or with rotation with either of his/her legs, the left leg being the active leg in the drawing.

In other use positions of the device 10, it is normal to provide a bench 90 having an upper surface 92 for supporting contact with body portions of the exerciser. Such bench 90 includes a body 94. having a lower surface including positioning openings adapted for receipt of the positioning posts 96 provided on the upper surfaces of the forward and rear shelves 20 and 22. In this way then, the body 94 contacts the shelves 20 and 22 and spans the contact surface 18 and provides an overall surface 92 as previously explained for support of the exerciser. Such surface may be provided with appropriate padding and the like. The modes in which the device 10 may be used are shown in FIG. 11 wherein an exerciser is shown face down on the upper surface 92. In such position, he/she may propel the device forward and back, side to side, diagonally or with rotation using the arms or the legs which may be relatively closed as shown or open. Also, the exerciser may rest his/her back on surface 92 and perform the same movements with either legs or arms.

Figure 1:
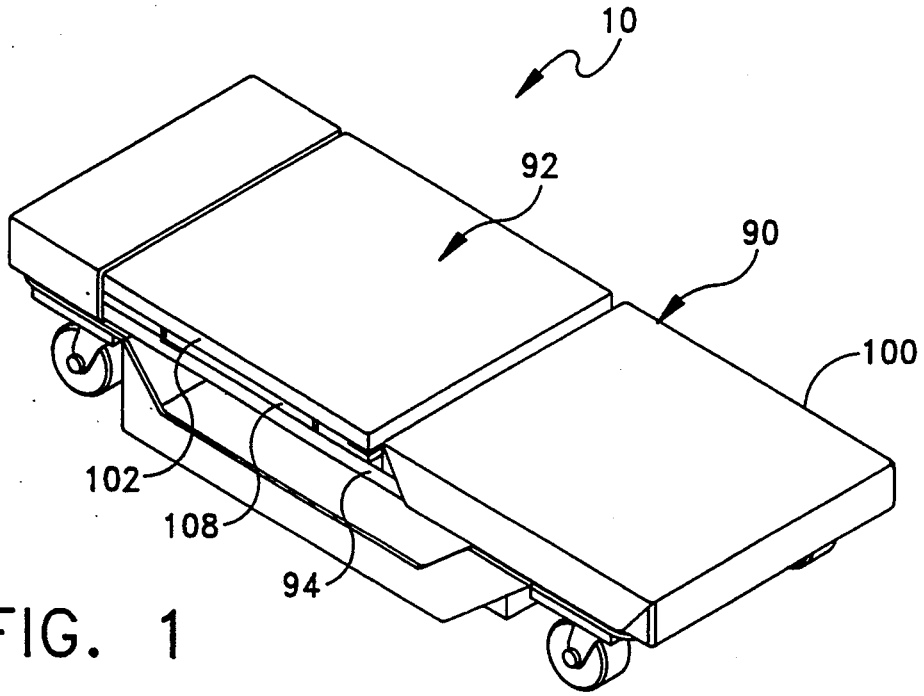
FIG. 1 is a perspective view showing one form of the device of the present invention in one alternative position thereof.
Figure 2:
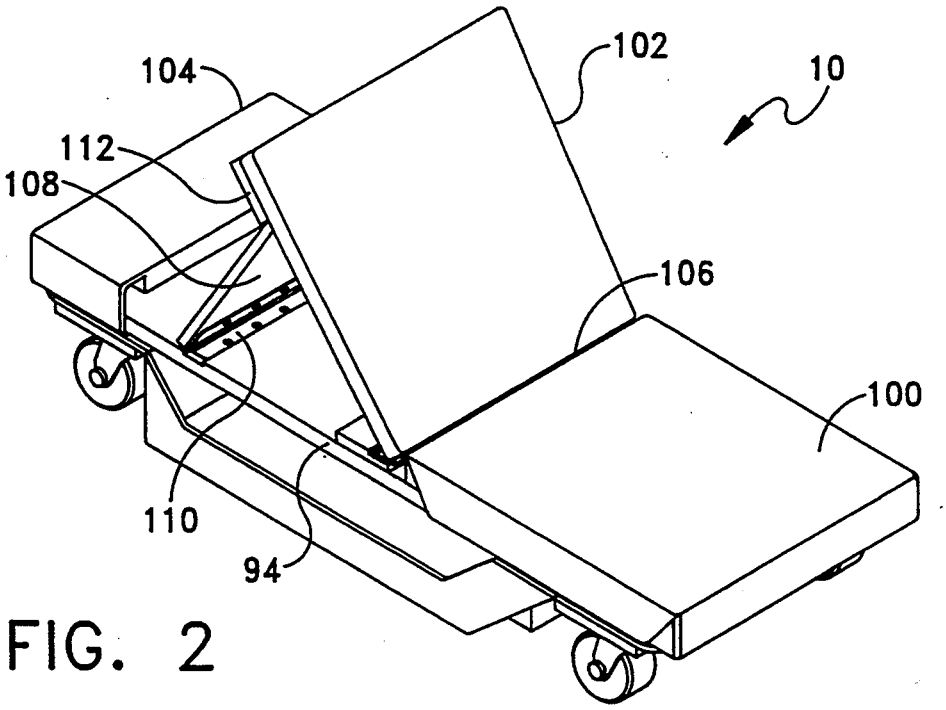
FIG. 2 is a perspective view similar to FIG. 1 but showing an alternate body supporting position thereof.

Additionally, the bench 90 includes a forward portion 100, a central portion 102 and a rear portion 104. The forward and central portions are hingedly connected together by a first hinge 106 by which the central portion 102 may be upwardly tilted such the user may sit on the upper surface of the forward portion 100 and rest lower back portions against the central portion 102. This exercise position is maintained by means of a brace 108 hingedly connected to the body 94 by a second hinge 110. In that respect, the brace may be positioned flat against the top surface of the body 94 in a storage position such as depicted in FIG. 1 or in a use position as depicted in FIG. 2. The angular relationship between the first and second portions 100 and 102 may be achieved by a stop member 112 under which the brace is fixed. In this form of the device, the exerciser E sits on section 100, rests against 102 and propels the device forward or back, side to side, diagonally or with rotation by the legs.

Turning now to FIGS. 7 through 10 of the drawings, a still further modified form of the present invention is depicted in that an alternate second contact means or brake assembly 120 is provided. Such takes the form of a pad 122 extending entirely across the lower surface of the frame generally centrally thereof and by which adjustment to vary the rolling resistance is achieved by a pair of housings 126 similar to housing 34 described in the previous embodiment. Such housings 126 include opposed slots 128 and are adapted to receive a coil spring 130 similar to the previously explained embodiment and are further provided with an opening 131 in the bottom through which a sleeve 132 equivalent to the secondary box 8 is adapted to extend. The lower surface of the sleeve 132 is connected to the pad 122 and the vertical pad adjustment is brought about in the same manner as previously explained by a carriage bolt 134 extending across the slots and attached at their opposite ends by knurled adjustment knobs 136 which when both appropriately tightened will vary the normal spacing distance of the pad from the frame bottom. Generally, the level of adjustment of both knobs is equal, that is, when using a scale to measure distances, then both knobs are set at the same setting on the scale. Suitable positioning members 138 through which the carriage bolts extend and similar to construction to the head 62 as previously explained are included such that, as before, rolling resistance of the unit vis-a-vis the floor can be modified and force the exerciser to apply greater or lesser exertion force in order to move the device in the intended manner.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A multi-use exercising device for use on a horizontal surface including a frame in turn including an essentially planar supporting surface for supporting a body portion of an exerciser and further defining a lateral plane, said frame having first floor contact means providing multi-directional movement of said supporting surface within said lateral plane including front to rear and side to side movement such that the exerciser body portion may be positioned on said supporting surface while moving said frame in one or more of said directions by exerting force on the horizontal surface with other exerciser body portions which are not supported on said supporting surface such that the device and exerciser are mutually propelled by such exerting force, said frame having second floor contact means entirely separate from said first floor contact means, and said second floor contact means including means for adjusting the resistance to movement of said frame such that the exerciser exerting force needed to move said frame can be progressively increased or decreased and means for maintaining resistance to movement of said frame independent of the position or activity of the exerciser relative to said frame.

2. The device of claim 1, said second floor contact means including a body positioned on said frame and including a member having a lower surface for frictionally contacting the horizontal surface, said member being continually downwardly biased for said contact with the horizontal surface and means for positioning said member with respect to said frame such that the position of said member may be adjustably fixed with respect to said frame so as to alter the force with which said member contacts the horizontal surface.

3. The device of claim 2, said member positioned in an open-ended housing in turn attached to said frame, spring means positioned in said housing for continually downwardly urging said member and locking means for adjustably fixing the position of said member with respect to said housing.

4. The device of claim 1, said first floor contact means being a plurality of wheel assemblies positioned on said frame and extending downwardly therefrom, each said wheel assembly including a wheel freely rotatable in a plane normal to said lateral plane and said wheel assemblies also freely rotatable in said lateral plane.

5. The device of claim 4, said frame including forward and rear shelf portions from which said wheel assemblies depend and an intermediate frame portion connecting said forward and rear shelf portions and disposed lower than said shelf portions, said intermediate frame portion having upper and lower surfaces wherein said upper surface thereof defines said essentially planar body supporting portion.

6. The device of claim 1, said essentially planar body supporting surface comprising an essentially continuous surface disposed on the upper surface of said frame.

7. The device of claim 6, said body supporting surface being a separate bench including a central section that is alternatively movable to a position angularly inclined with respect to said frame.

8. The device of claim 5, said body supporting portion being a separate bench including a central section that is alternatively movable to a position angularly inclined with respect to said frame, said bench spanning said intermediate frame portion.

9. The device of claim 2, said frictional contact member positioned generally centrally of said frame both with respect to the length and width thereof.

10. The device of claim 2, said frictional contact member positioned entirely across the width of said frame generally centrally thereof.

11. A multi-use exercising device for use on a horizontal surface including a frame in turn including an essentially planar supporting surface for supporting a body portion of an exerciser and further defining a lateral plane, said frame having first floor contact means providing multi-directional movement of said supporting surface within said lateral place including front to rear and side to side movement such that the exerciser body portion may be positioned on said supporting surface while moving said frame in one or more of said directions by exerting force on the horizontal surface with other exerciser body portions which are not supported on said supporting surface such that the device and exerciser are mutually propelled by such exerting force, said frame having second second contact means entirely separate from said first floor contact means, and said second contact means including means for adjusting the resistance to movement of said frame such that the exerciser exerting force needed to move said frame can be progressively increased or decreased and means for maintaining the resistance to movement of said frame independent of the position or activity of the exerciser relative to said frame, said second floor contact means including a body positioned on said frame and including a member having a lower surface for frictionally contacting the horizontal surface, said member being continually downwardly biased for said contact with the horizontal surface and means for positioning said member with respect to said frame such that the position of said member may be adjustably fixed with respect to said frame so as to alter the force with which said member contacts the horizontal surface, said member positioned in an open-ended housing in turn attached to said frame, spring means positioned in said housing for continually downwardly urging said member and locking means for adjustably fixing the position of said member with respect to said housing.

12. A multi-use exercising device for use on a horizontal surface including a frame in turn including an essentially planar supporting surface for supporting a body portion of an exerciser and further defining a lateral plane, said frame having first floor contact means providing multi-directional movement of said supporting surface within said lateral place including front to rear and side to side movement such that the exerciser body portion may be positioned on said supporting surface while moving said frame in one or more of said directions by exerting force on the horizontal surface with other exerciser body portions which are not supported on said supporting surface such that the device and exerciser are mutually propelled by such exerting force, said frame having second second contact means entirely separate from said first floor contact means, and said second contact means including means for adjusting the resistance to movement of said frame such that the exerciser exerting force needed to move said frame can be progressively increased or decreased and means for maintaining the resistance to movement of said frame independent of the position or activity of the exerciser relative to said frame, said first floor contact means being a plurality of wheel assemblies positioned on said frame and extending downwardly therefrom, each said wheel assembly including a wheel freely rotatable in a plane normal to said lateral plane and said wheel assemblies also freely rotatable in said lateral plane.

13. The device of claim 12, said frame including forward and rear shelf portions from which said wheel assemblies depend and an intermediate frame portion connecting said forward and rear shelf portions and disposed lower than said shelf portions, said intermediate frame portion having upper and lower surfaces wherein said upper surface thereof defines said essentially planar body supporting portion.

14. The device of claim 13, said body supporting portion being a separate bench including a central section that is alternatively movable to a position angularly inclined with respect to said frame, said bench spanning said intermediate frame portion.

* * * * *